United States Patent [19]

Ney et al.

[11] Patent Number: 4,865,563

[45] Date of Patent: Sep. 12, 1989

[54] ELECTRICAL CONNECTOR

[75] Inventors: Reuben E. Ney, Mount Joy; Bryon L. Walters, Camp Hill, both of Pa.

[73] Assignee: AMP Incorporated, Harrisburg, Pa.

[21] Appl. No.: 683,847

[22] Filed: Dec. 20, 1984

[51] Int. Cl.[4] ..... H01R 4/24

[52] U.S. Cl. ..... 439/404

[58] Field of Search ..... 339/97 R, 97 P, 98, 339/99 R, 95 D, 103 R, 103 M, 109, 110, 264

[56] References Cited

U.S. PATENT DOCUMENTS

| | | | |
|---|---|---|---|
| 2,196,964 | 4/1940 | Lee | 339/97 |
| 2,238,834 | 4/1941 | Travers . | |
| 3,430,187 | 2/1969 | DeMan et al. . | |
| 3,437,980 | 4/1969 | Smith . | |
| 3,629,794 | 12/1971 | Kourimsky | 339/95 D |
| 3,721,939 | 3/1978 | Paugh . | |
| 3,861,778 | 1/1975 | Capra . | |
| 3,977,754 | 8/1976 | Brummans | 339/95 D |
| 3,986,765 | 10/1976 | Shaffer et al. . | |
| 4,191,443 | 3/1980 | Doyle | 339/103 R |

*Primary Examiner*—Joseph H. McGlynn
*Attorney, Agent, or Firm*—Katherine A. Nelson

[57] ABSTRACT

Provided is a device for interconnecting high voltage electrical components employing a terminal assembly housing, a poke-in terminal, an elongated receptacle featuring a mounting means, anti-surface tracking elements, an axially extending cavity in communication with the terminal, and a compressible snap cap assembly which compresses about, grips and secures the wire.

11 Claims, 5 Drawing Sheets

ELECTRICAL CONNECTOR

FIELD OF THE INVENTION

This invention relates to an electrical connector. More particularly, this invention relates to a high voltage, lead wire connector incorporating an elongated, poke-in type terminal bearing, receptacle having a snap cap assembly for gripping the wire.

BACKGROUND OF THE INVENTION

In the high voltage interconnection field reliable assembly of components and conductors is paramount. Many devices embodying a host of designs have been employed to assure reliable connection. Often such devices are used on the assembly line or in the field and require considerable time to establish proper interconnection.

Many conventional interconnectors incorporate an internally housed terminal to which a lead wire must be soldered or welded and then upon establishing a permanently fixed connection, a threaded cap is screwed onto the opposite end of the housing to hold the lead wire in place which provides strain relief to the terminal/lead wire connection. Although adequate for many purposes, such manipulation may be undesirable in many situations.

In order to eliminate the requirement for soldering or welding of the lead wire to the terminal, production efficiencies are enhanced by the use of poke-in type terminals which establish wiping electrical contact between the lead wire and the terminal. Such assemblies are exemplified by the "Mag-Mate" terminal produced by AMP Incorporated of Harrisburg, Pa.

However, even where a poke-in type connector is incorporated, the use of potting or a threaded cap member to secure the lead wire within the connector involves considerable time and a corresponding increase in assembly production costs. Lastly, in certain environments, minimal working area is available limiting access of the user for screwing the cap into the receptacle.

In all of the prior art relating to this field, nowhere is found a reliable, versatile, rapidly employable interconnector which maximizes production efficiency.

SUMMARY OF THE INVENTION

It is an object of the present invention to provide a convenient, durable, wire interconnector incorporating desirable features of the prior art but avoiding undesirable features thereof.

It is another object of this invention to provide an interconnector for connecting a lead wire to another conductive member in a high voltage apparatus.

Still another object of this invention is to establish a reliable connection between two conductive members in a minimum of time and using a device readily adapted to automated techniques.

Yet another object of this invention is to provide a connector bearing a terminal and securing two electrically conductive members connected to the terminal where a minimum of strain is imparted to the terminal connection.

Another object of this invention is to provide a connector requiring minimum production costs but maximizing assembly efficiencies.

Still another object of this invention is to provide a mountable, versatile, high voltage, interconnector readily adapted to a number of uses.

It is yet another object of this invention to provide an interconnector which deters arcing between the high voltage connection and a grounded surface.

These and many other objects are satisfied by an interconnector featuring a poke-in type terminal for establishing wiping electrical connection between a wire and a second electrical conductor where the terminal is contained within a dielectric assembly. The terminal assembly is attached to an elongated, axial cavity bearing housing such that the terminal and cavity are in communication with each other and where a wire inserted through the cavity is connectable with the terminal. Disposed at the opposite end of the housing is a snap cap, receiving assembly defining substantially axial disposed, compressible tines which are adapted to compress onto an axially disposed wire upon translation of a toothed snap cap thereover. The snap cap coacts with the receiving assembly to be releasably secured thereto as the tines are compressed onto the wire thereby providing strain relief to the wire/terminal connection.

Other objects are satisfied by this invention as it provides a fast interconnection means by which the relative position of connected electrically conductive members may be fixed prior to potting. Moreover, potting the interconnector may be limited to the terminal assembly if desired. Also the terminal assembly structure deters migration of uncured potting into the electrical connections. The invention further contemplates a structure which facilitates insertion of a wire through the cavity of the receptacle by incorporating a decreasing radius, conical guide leading to the terminal. Furthermore, the preferred terminal structure assures wiping electrical connection with the wire and retention of the wire therein.

An additional aspect of this invention contemplates a simple snap cap structure adapted to slide over and firmly engage an assembly with the wire disposed therein where the assembly is located at the opposite end of the connector from the terminal assembly and where the translation of the snap cap compresses the assembly into the wire insulation thereby providing strain relief to the wire terminal connection.

Still other aspects of this invention contemplates the incorporation of superior poke-in, electrical terminals such as the Mag-Mate terminals produced by AMP incorporated of Harrisburg, Pennsylvania and to provide a large range of interconnector sizes for housing a variety of terminal sizes adapted for use in many situations.

A further aspect of this invention is to provide a reliable high voltage system interconnection between conductive members.

Other aspects of this invention permit the terminal assembly to hold a second conductive member without potting. If potting of the member is desired, it may be performed following assembly of the terminal assembly.

The invention further provides features which reduce arcing from high voltage breakdown caused by surface tracking dielectric materials.

Most importantly, from a production and economic perspective, this invention provides an easily assembled, uncomplicated structure, assuring a reliable interconnection on the assembly line or in the field.

In order not to belabor the salutary aspects of this invention, lastly, it provides a versatile interconnection means which can be readily adapted both in size and mounting features to be employable in such varied environments as a retrofit anode connection to a flyback transformer or as a bulkhead feedthrough connective device.

These and other aspects of the invention will become apparent to the skilled artisan upon review of the following disclosure.

DETAILED DESCRIPTION OF THE PREFERRED EMBODIMENT

Figure 1:
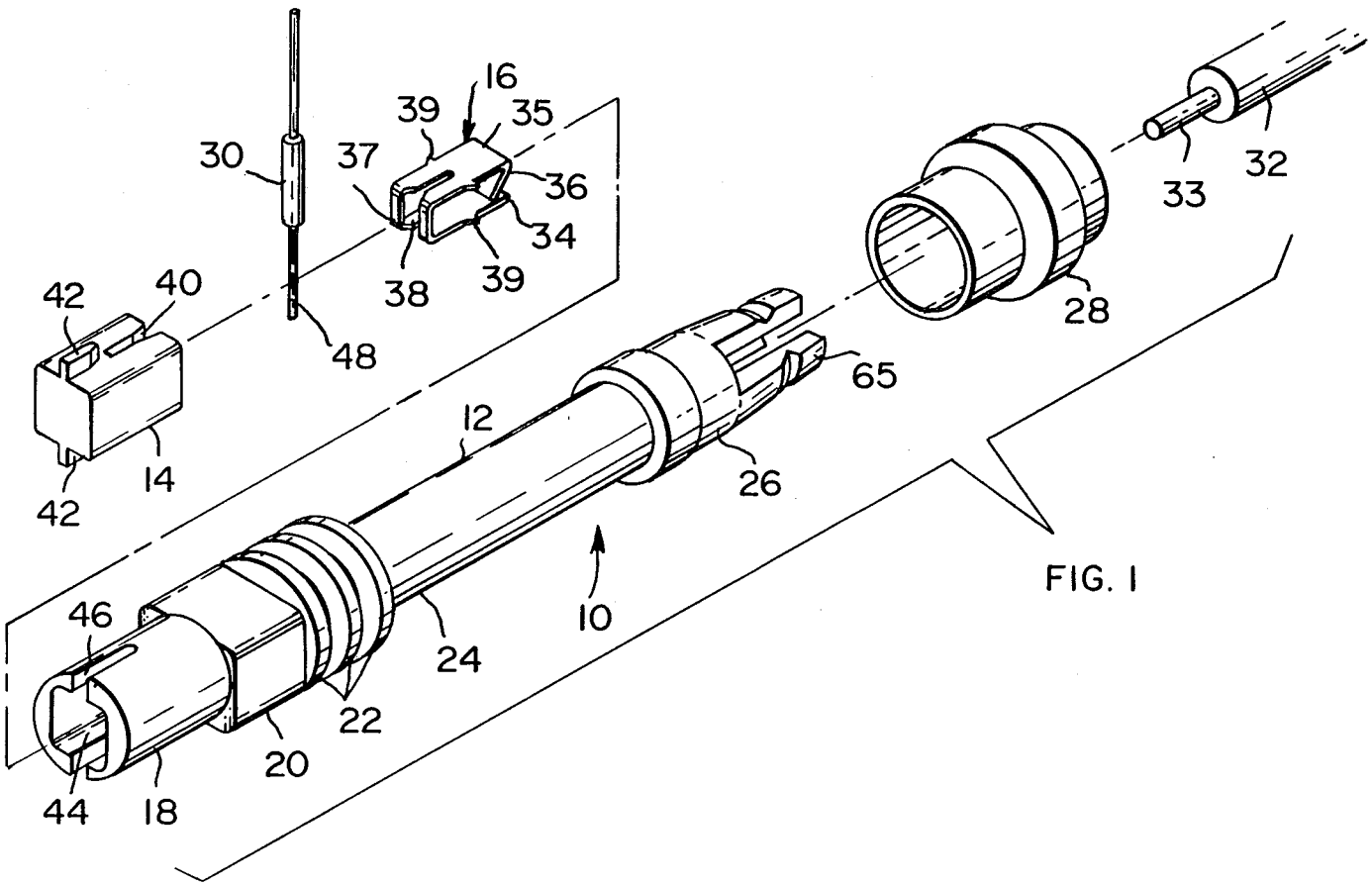
FIG. 1 is an exploded perspective view of the apparatus of the present invention.

Referring now to FIG. 1, there is illustrated an unassembled electrical connector 10. For definitional purposes the terminal containing end (left side) will hereinafter be referred to as the distal end and the snap connector bearing end, the proximal end.

Connector 10 features snap cap 28 and elongated, hollow cylindrical dielectric receptacle 12 incorporating terminal housing 14, terminal 16, terminal housing bracket 18, shouldered holder means 20, annular spacer rings 22, hollow cylindrical housing member 24 and compressible, cap stopping assembly 26. Also illustrated are diode 30 which fits within and is secured by terminal housing 14 in electrical contact with terminal 16 and insulated wire 32 including stripped, pigtail section 33. The assembly and function of connector 10 will become apparent from the following discussion.

Turning to the configuration of terminal 16, terminal housing 14 and terminal housing bracket 18, they are designed to form an interlocking structure at the distal end of connector 10 and to secure an electrical member (in this case diode 30) thereto. The terminal structures preferably incorporate the features of the "Mag-Mate" system developed and sold by assignee of this application and embodied in the following U.S. Pat. Nos. which are incorporated herein by reference for this purpose: 3,979,615, 4,026,013 and 4,130,331.

Figure 2:
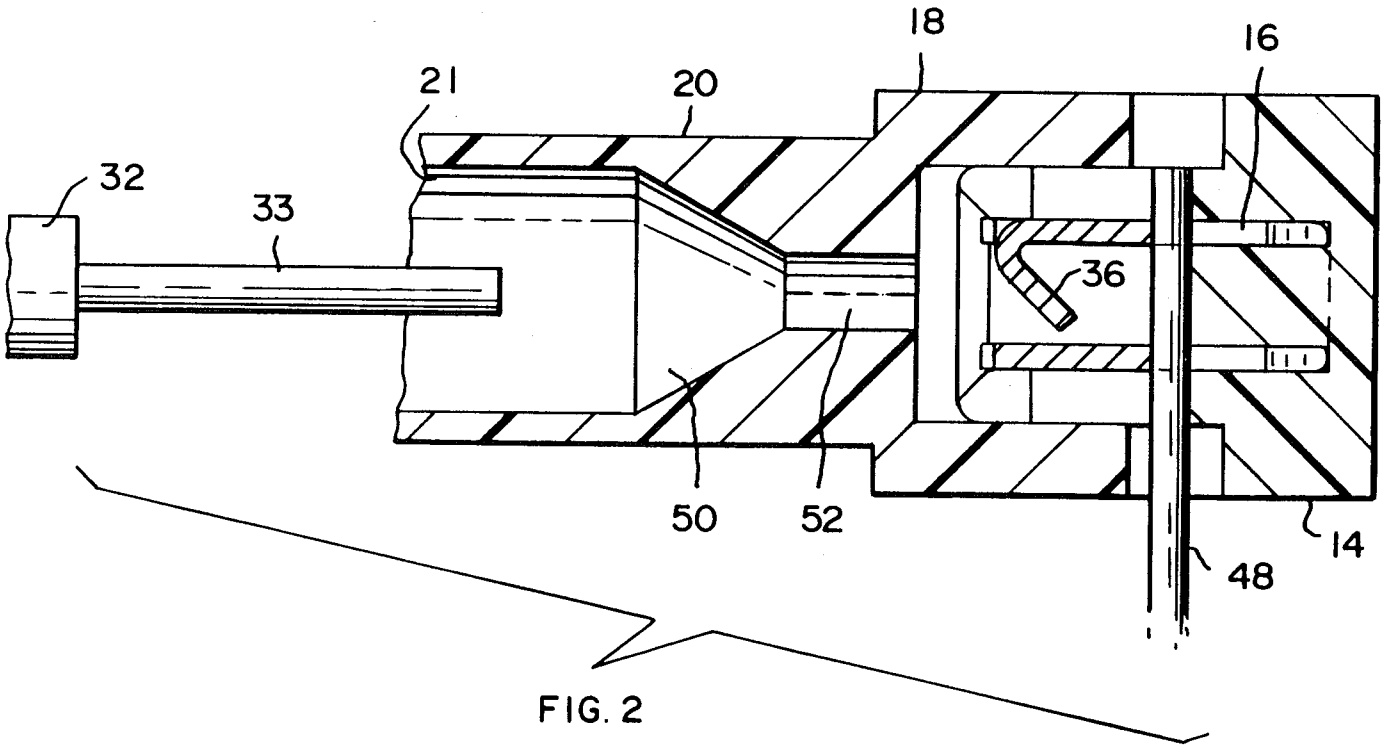
FIG. 2 is a cutaway side view of a wire receiving terminal.

Briefly describing the terminal assembly and referring to FIGS. 1 and 2, terminal 16 is composed of a conductive material e.g. copper, tin, etc., and has a U-shaped cross-section. Leg 34 is substantially flat and continuous while leg 35 includes projecting spring contact member 36 directed inwardly and toward base 37 of the "U"-shaped member 34. A centrally-disposed slot 38 is provided in base 37 and extends approximately half the length of legs 34 and 35 so as to divide the distal portion of terminal 16 into two equal portions. Additionally, projecting outwardly from legs 34 and 35, are securing barbs 39, adapted to secure terminal 16 by engaging the interior walls of housing 14.

Housing 14 includes a cavity into which terminal 16 is slidably received. Slots 40 are proximally disposed along the upper and lower surfaces of housing 14 and are complementary with slots 38 of terminal 16. Distal, positioning lugs 42 are located behind and lie in the same transverse plane as do slots 40. The exterior cross-sectional geometry (square in this embodiment) of housing 14 is slidingly receivable and complementary to cavity 44 formed in bracket 18. Upper and lower housing slots 46 are complementary to slots 40 and lugs 42 which slide therein. The lugs 42 provide an interference fit into slots 46 for securing terminal housing 14 therein.

To achieve an integrated terminal assembly structure in a connective relationship with diode 30, the following steps are taken. Diode lead wire 48 is inserted through slot 38, so as to abut the bottom of the slot. Terminal 16 is then pushed into housing 14 in a manner such that base 37 abuts the back wall, barbs 39 engage the interior thereof and wire 48 projects through upper or lower slot 40. The dual-slotted structure provided by the assembly allows wire 48 to be inserted from either side. The dual slotted structure further provides sealing around wire 48 to prevent migration of potting into the terminal. It should also be noted that wire 48 is rendered immobile relative to terminal 16 and housing 14 as it is compressed against the bottoms of slots 38 and 40 in an oppositely directed manner. Housing 14 is then inserted into cavity 44 of bracket member 18 as lugs 42 and wire 48 are guidingly received by slots 46. The terminal assembly or distal end of the connector may then be potted with an appropriate adhesive. Typically high voltage connectors are potted to prevent voltage breakdown during operation. The terminal assembly end of the present connector may be potted after assembly. Migration of potting material into the connector is prevented by the sealing features of the dual slotted structure 40 and the interference fit of lugs 42, and housing slots 46.

Figure 3:
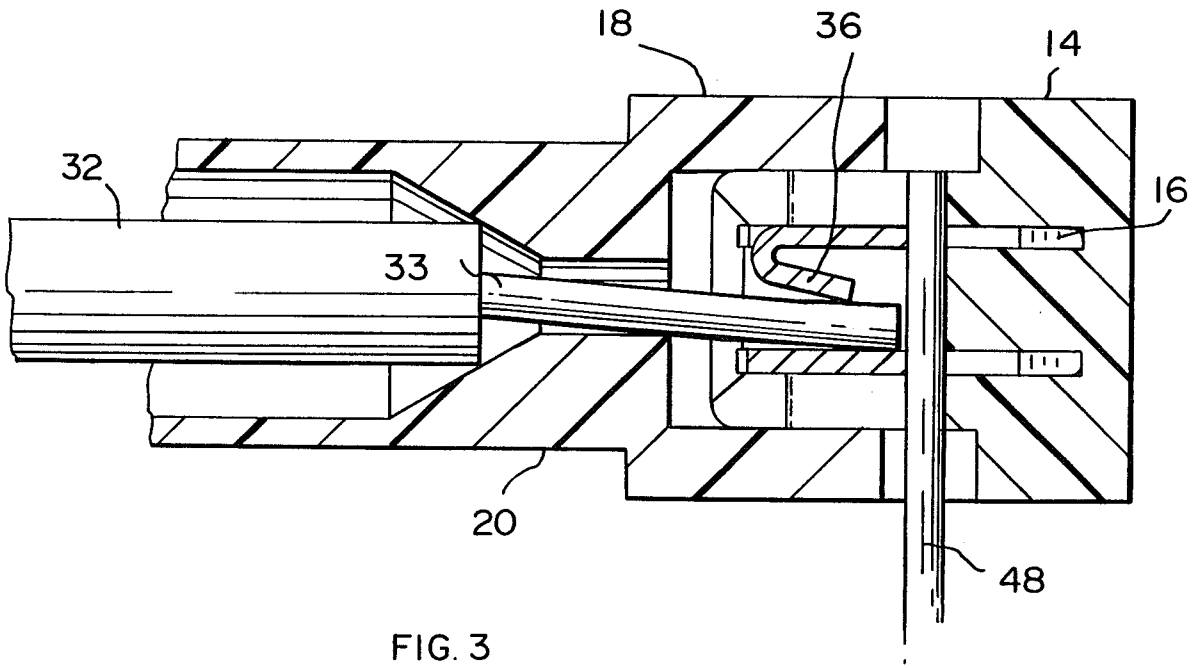
FIG. 3 is a cutaway side view of the wire receiving terminal in a connective mode.

Referring now to FIGS. 2 and 3, there is illustrated, the mechanism by which lead wire 32 is connected to terminal 16 and therefore wire 48. Lead wire 32 being stripped of insulation at one end features pigtail wire extension 33. Lead wire 32 may be a solid wire, stranded wire, or fused or solder dipped stranded wire. If stranded wire is used, pigtail 33 is generally solder dipped to provide increased wire strength for entering the terminal assembly. Wire 32 is passed into the proximal end of connector 10 through center bore 21 and into the terminal assembly. Before reaching terminal 16, pigtail 33 passes through the distal end of the central bore 21 and contained within holder 20, which contains conical guide 50 and narrow bore section 52. Section 52 is in communication with cavity 44 and therefore terminal 16. The guiding aspects of holder 20 are contributed to by the diameter of section 52 being smaller than the outer diameter of the insulation about wire 32 but larger than that of pigtail 33. As bore section 52 being aligned with terminal 16, permits pigtail 33 to pass therethrough to engage spring member 36, thereby establishing wiping electrical contact as it is inserted between the member 36 and leg 34 of terminal 16. Due to the connection of electrically conductive terminal 16 with wire 48, electrical connection is established between wire 48 and lead wire 32.

Holder 20, being composed of dielectric material, should have walls of sufficient thickness, as should the entirety of receptacle 12, to reduce the chances of voltage breakdown. Referring, generally to certain external features of receptacle 12, holder 20, incorporating guide 50 and bore 52, defines a block-like periphery which is adapted to mount on a bracket. It is to be understood that the external features of the connector may be modified to permit the connector to be used for other applications such as mounting in a bulkhead or can. Regarding mounting of receptacle 12 to an appropriate device such as a transformer, the block configuration facilitates insertion thereof into a mounting bracket including coacting, cantilevered, spring members which engage the block walls. It is evident that other mounting techniques, such as screw receiving extensions, may also be incorporated for mounting in any conventional manner.

Voltage tracking causing the arcing phenomena is noticeable especially in high voltage systems employing potted dielectric housed connectors. Such arcing can be explained by the tendency of an electric field to travel over the surface of the dielectric housing toward a grounded surface. Increasing the length of the housing tends to deter arcing as it prevents breakdown of thie high voltage field within the connector. In the preferred embodiment spacer rings 22 are incorporated to deter arching. As illustrated in FIG. 1, spacer rings 22 are disposed immediately proximate to holder 20 and form a scalloped surface thereby increasing the surface length of receptacle 12 and deterring surface tracking of the electric field thereover.

Figure 4:
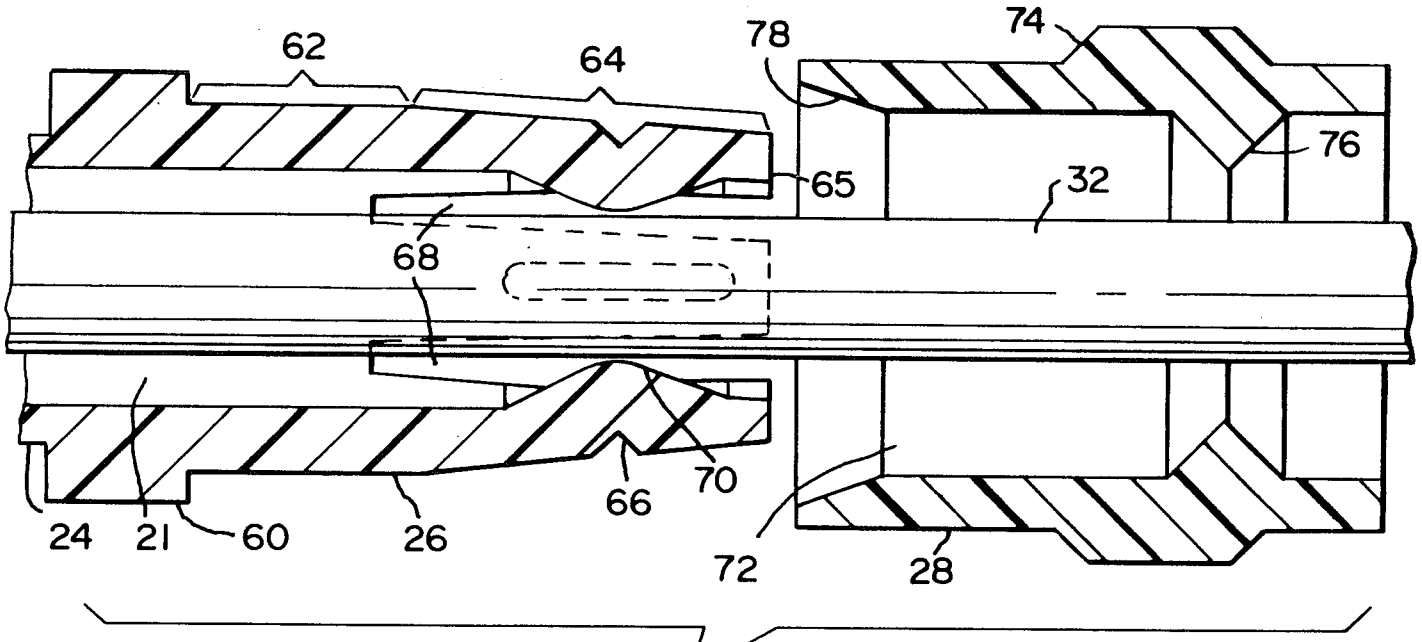
FIG. 4 is a cutaway side view of a snap cap and receptacle before assembly.

Moving now to FIG. 4, there is illustrated the proximal end of unassembled connector 10 featuring assembly 26 and snap cap 28. Assembly 26 defines a hollow cylindrical member having a wall thickness greater than housing member 24 and is adapted to slidingly receive wire 32. Assembly 26 extends substantially colinearly with and proximally from housing member 24. Three principal elements are featured; positive stop flange member 60, constant diameter portion 62 and radially descending, slotted section 64. Section 64 provides three elongated slots 68 thereby defining radially descending, proximally directed tines 65. Compressible tines 65 incorporate external, circumferentially-disposed notches 66 and annularly disposed internal, triangulating, gripping elements 70. Gripping elements 70 project toward the central axis of assembly 26 and are adapted to engage wire 32 upon compression. Tines 65 are so arranged that application of a radial, inwardly directed force results in compression of tines 65 about wire 32. Radial, inward compression of tines 65 is achieved with snap cap 28.

Cylindrical snap cap 28 surrounds wire 32 which passes through cavity 72. Cap 28 has a constant diameter outer surface excepting annular manipulation lug 74. The interior of cap 28 defines a triangulating, annular, inwardly projecting tooth 76 and annular, outwardly-flared, bevel 78 at the distal end of cavity 72.

Figure 5:
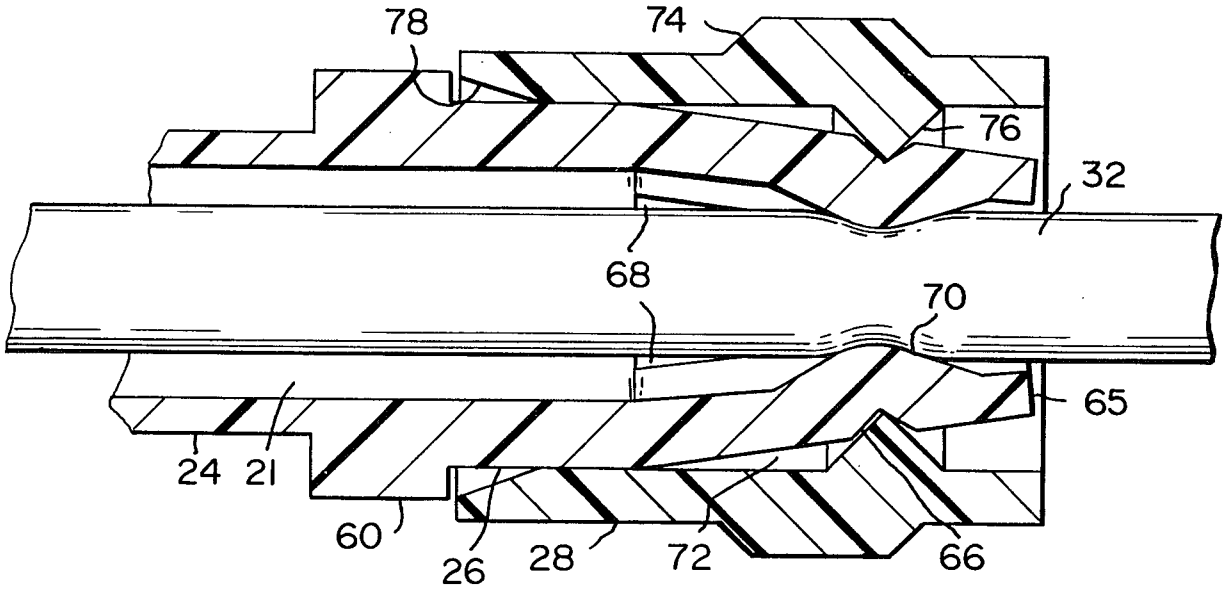
FIG. 5 is a cutaway side view of the assembled snap cap and receptacle.

Turning now to FIG. 5, the cooperating aspects of the elements of assembly 26 and cap 28 are clearly depicted. Bevel 78 facilitates sliding cap 28 over tines 65 until the distal edge of the cap abuts flange 60. The outer diameter of the proximal-most portion is slightly less than the diameter defined by tooth 76 thereby allowing it to freely slide over the proximal end of tines 65. Upon continued distally directed movement of cap 28, tooth 76 engages the outer, inclining surface of tines 65, compressing them toward the central axis. As tines 65 move inwardly grippers 70 engage and compress lead wire 32. When completely engaged, tooth 76 snaps into notch 66 and the distal edge of end cap 28 abuts flange 60. Slots 68 being positioned equidistantly along the circumference of section 64 permit uniform, inwardly directed compression of gripping elements 70 into the insulation of wire 32 thereby reversably clamping assembly 26 to wire 32. Lug 74 is provided to facilitate translating cap 28 along section 64 for assembly and disassembly from section 64. The clamping aspects of the arrangement provide an inherent strain relief mechanism against any translation of lead wire 32 and pigtail 33 lodges within terminal 16.

The connector structure may incorporate other desirable features. Materials and other elements may be incorporated to achieve anti-corona discharge characteristics. Furthermore, combining a plurality of similar connector structure into a unitary member can provide an interconnection assembly for one or more cooperating lead wire and ground wire combinations. As noted above, a host of conventional attachment means may be incorporated so as to render the connector adaptable to most any situation.

These modifications and other variations of the preferred embodiment should now be apparent, or become apparent from routine experimentation, to the skilled artisan and are therefore intended to fall within the scope of the invention as defined by the following claims.

We claim:

1. An electrical connector for connecting a first electrical conductor to a second electrical conductor, comprising:

electrical terminal means having a first terminating section and a second terminating section;

dielectric first housing means in which said electrical terminal means is to be secured, said first housing means having opposing slotted surfaces adapted to receive and secure said first electrical conductor, said first terminating section of said electrical terminal means electrically terminating with the first electrical conductor when said electrical terminal means is secured in said first housing means;

second dielectric housing means having a first passageway means therethrough along which the second electrical conductor is to extend, said first housing means being mateable with one end of said second housing means with said second terminating section being aligned with said first passageway means so that the second electrical conductor can be terminated in said second terminating section; and dielectric strain-relief means having a second passageway means therethrough along which the second electrical conductor is to extend, said second passageway means being alignable with said first passageway means, said strain relief means being securable to said second dielectric housing means whereby when said first and second electrical conductors are terminated in said first and second terminating portions of said electrical terminal means, said strain relief means provides strain relief for said second electrical conductor.

2. The electrical connector as described in claim 1 wherein said electrical terminal means is a stamped and formed member, said first terminating section being comprised of an elongated slot means for receiving and terminating said first electrical conductor and said second terminating section having a spring contact member for securably receiving and terminating said second electrical conductor.

3. The electrical connector as described in claim 1 further including means to prevent voltage surface tracking.

4. The electrical connector as described in claim 3 further including means to prevent voltage surface tracking.

5. The electrical connector as described in claim 1 wherein said second dielectric housing means has compressible, tined gripping means at a second end for gripping said second electrical conductor, said gripping means adapted to cooperate with said strain-relief means.

6. The electrical connector as described in claim 5 wherein said strain relief means is snappable over said compressible gripping means to securably hold said second electrical conductor in said connector.

7. An electrical connector for connecting a first electrical conductor to a second electrical conductor, comprising:

electrical terminal means having a first terminating section and a second terminating section;

dielectric first housing means in which said electrical terminal means is to be secured, said first terminating section of said electrical terminal means electrically terminating with the first electrical conductor when said electrical terminal means is secured in said first housing means;

second dielectric housing means having a first passageway means therethrough along which the second electrical conductor is to extend, said one end of said second dielectric housing means having opposing slotted surfaces adapted to receive said first electrical conductor when said first housing means is mated with said second housing means, said first housing means being mateable with one end of said second housing means with said second terminating section being aligned with said first passageway means so that the second electrical conductor can be terminated in said second terminating section; and dielectric strain-relief means having a second passageway means therethrough along which the second electrical conductor is to extend, said second passageway means being alignable with said first passageway means, said strain relief means being securable to said second dielectric housing means whereby when said first and second electrical conductors are terminated in said first and second terminating portions of said electrical terminal means, said strain relief means provides strain relief for said second electrical conductor; and 8. The electrical connector as described in claim 7 wherein said second dielectric housing means has compressible, tined gripping means at a second end for gripping said second electrical conductor, said gripping means adapted to cooperate with said strain-relief means.

9. The electrical connector as described in claim 8 further including means for preventing migration of potting material into the electrical terminal means.

10. An electrical connector for connecting a first electrical conductor to a second electrical conductor, comprising:

electrical terminal means having a first terminating section and a second terminating section;

dielectric first housing means in which said electrical terminal means is to be secured, said first terminating section of said electrical terminal means electrically terminating with the first electrical conductor when said electrical terminal means is secured in said first housing means;

second dielectric housing means having a first passageway means therethrough along which the second electrical conductor is to extend, said one end of said second dielectric housing means having opposing slotted surfaces adapted to receive said first electrical conductor when said first housing means is mated with said second housing means, said first housing means being mateable with one end of said second housing means with said second terminating section being aligned with said first passageway means so that the second electrical conductor can be terminated in said second terminating section;

dielectric strain-relief means having a second passageway means therethrough along which the second electrical conductor is to extend, said second passageway means being alignable with said first passageway means, said strain relief means being securable to said second dielectric housing means whereby when said first and second electrical conductors are terminated in said first and second terminating portions of said electrical terminal means, said strain relief means provides strain relief for said second electrical conductor; and means for preventing migration of potting material into the electrical terminal means.

11. The electrical connector as described in claim 10 wherein said electrical terminal means is a stamped and formed member, said first terminating section being comprised of an elongated slot means for receiving and terminating said first electrical conductor and said second terminating section having a spring contact member for securably receiving and terminating said second electrical conductor.

* * * * *